US005895047A

United States Patent [19]

Callahan

[11] Patent Number: 5,895,047

[45] Date of Patent: Apr. 20, 1999

[54] METHOD FOR A NOVEL CARD GAME

[76] Inventor: Paul E. Callahan, 4033 W. Griswold Rd., Phoenix, Ariz. 85051

[21] Appl. No.: 08/949,056

[22] Filed: Oct. 10, 1997

[51] Int. Cl.[6] ..... A63F 1/00

[52] U.S. Cl. ..... 273/292

[58] Field of Search ..... 273/292, 309

[56] References Cited

U.S. PATENT DOCUMENTS

| | | | |
|---|---|---|---|
| 4,362,303 | 12/1982 | Pell | 273/274 |
| 4,651,997 | 3/1987 | Wood | 273/274 |
| 4,659,087 | 4/1987 | Shen et al. | 273/274 |
| 5,072,946 | 12/1991 | Miller | 273/292 |
| 5,098,107 | 3/1992 | Boylan et al. | 273/292 |
| 5,257,810 | 11/1993 | Schorr et al. | 273/292 |
| 5,324,041 | 6/1994 | Boylan et al. | 273/292 |
| 5,362,064 | 11/1994 | Lofink et al. | 273/292 |
| 5,395,119 | 3/1995 | Jacob et al. | 273/274 |
| 5,397,128 | 3/1995 | Hesse et al. | 273/292 |
| 5,413,353 | 5/1995 | Demarest et al. | 273/292 |
| 5,522,595 | 6/1996 | Wong | 273/292 |
| 5,529,309 | 6/1996 | Bartlett | 273/292 |

*Primary Examiner*—Benjamin H. Layno
*Attorney, Agent, or Firm*—Frank J. McGue

[57] ABSTRACT

A game for a one or more bettors is played with a standard deck of cards. Each bettor places a wager on either a banker, a player or a tie to participate in the game. One card is dealt to each to the banker and to the player. If either or both of the cards dealt is an ace, then the ace or aces win the hand. If one of the cards dealt is a two, that hand loses unless both of the dealt cards are twos in which case only the tie bet wins. A tres card is then dealt. If the first two cards drawn have the same face value, the tres card is played to the tie. If the tres card is less face value than the two tied cards, both the banker and the player win. If the tres card is greater face value than the two tied cards, both the banker and the player lose. If the tres card is the same face value as the two tied cards, all bets win. If the two cards have the different face values the tres card is played whichever of the two cards has the lower face value. If the tres card is equal to the higher of the two cards, the tie bet wins. If the tres card differs from the higher face value card, the higher of the tres card or the higher face value card wins the bet.

8 Claims, 2 Drawing Sheets

METHOD FOR A NOVEL CARD GAME

TECHNICAL FIELD

This invention relates in general to games of chance, and, more particularly, to a method for a baccarat derived card game that can be played using multiple decks of cards.

BACKGROUND OF THE INVENTION

There are numerous card games which use standard playing cards. One such game is baccarat which is played most frequently from a shoe which represents an easy method of dealing cards from a multiple deck supply. Baccarat uses standard card decks with the jokers removed. In baccarat, the shoe is generally passed around the table to each individual bettor in a counterclockwise direction.

In baccarat, each numbered card 2 to 9 counts as its face value, aces count as one and face cards count as zero. The game is begun by dealing two cards to a Player and two cards to a Banker. The value of a hand is determined by first summing the value of the two cards dealt. If the card values summation is between ten and nineteen, the value ten is subtracted from such a card value summation to determine the hand value. If the card value summation is between twenty and twenty nine, then the value twenty is subtracted from the card value summation to determine the hand value. In short, the value of the "ones" digit after a card value summation is the hand value in baccarat.

Each party will stand or draw on the hand based upon a strict set of rules to determine the outcome. First, the Player stands if the Player's hand value is six through nine. If either the Player's hand or the Banker's hand is an eight or a nine, the hand is stopped and a decision is called as to the winner. The winner is the party with the larger hand value. If the parties tie, there is no action on the bet and bettors are free to increase, decrease, remove or change their bets.

If the Player's hand value is less than six, the Player draws a third card. The Banker draws or stands according to strict rules.

First, the Banker always draws on a Banker's hand value of zero through two and always stands on a Banker's hand value of seven through nine. But if the Banker's hand is between three and six, the decision to draw or stand is based upon the value of the Player's third card.

If the Banker's hand value is three, the Banker will draw a third card unless the Player's third card is an eight. If the Banker's hand value is four, the Banker will draw unless the Player's third card is a zero, one, eight or nine. If the Banker's hand value is five, the Banker will draw unless the Player's third card is zero through three or eight or nine. Lastly, if the Banker's hand value is six, the Banker will draw unless the Player's third card is zero through five and eight or nine.

Mathematically, the above rules provide a slight edge for the Banker. Without compensating for that edge, baccarat would be a losing proposition to casinos. Thus, casinos charge a commission, typically 5%, on winning Banker's hands which eliminates that slight edge and also provides the casino with its percentage.

As best seen in FIG. 1, a formal baccarat table has positions for twelve bettors 12, two dealers 18 and a caller 16. In front of each bettor are two boxes, one box (conventionally the closest to the bettor) for betting the Player will win and one box for betting that the Banker will win. The two dealers 18 are responsible for paying bets when bettors win and removing bets when bettors lose. The caller 16 is responsible for directing the game, the deal, calling the outcome and the passing of the shoe. The shoe passes from bettor to bettor as the game progresses.

Those skilled in the art will recognize that many casinos offer a more informal variation generally termed mini-baccarat in which only one casino employee performs both the dealer and caller functions.

As should be apparent, the rules of baccarat are difficult to learn and therefore intimidating to many bettors. There have been several attempts to derive a simpler, easier to understand game.

For example, U.S. Pat. No. 5,324,041 entitled "High Card Wagering Game" which issued on Jun. 28, 1994 to Boylan et al. discloses a card game in which one card is dealt to each player and one card to the dealer. The high card wins though there are a series of alternatives. There are seven bettor positions and a dealer position. Each bettor position has two betting areas, an area 12 for placing an ante bet and an area 14 for placing of a tie bet.

U.S. Pat. No. 5,072,946 entitled "Method of Playing a Wagering Casino-Type Card Game" which issued on Dec. 17, 1991 to Miller shows a card game in which one card is dealt to a first player and one to a second player. The numerical value of the first player's card is compared to the numerical value of the second player's card. There is then a series of options, but essentially, a tie ends the game or the player with the lower card gets another card whose numerical value is added to the first. If there is still no tie, this process continues until one of the hands exceeds a predetermined amount.

Further, U.S. Pat. No. 5,529,309 entitled "Card Game" which issued on Jun. 25, 1996 to Bartlett shows a game combining elements of baccarat and blackjack in which bettors play individual hands against a dealer.

Lastly, U.S. Pat. No. 5,413,353 entitled "Method of Playing a Blackjack Type Card Game" which issued on May 9, 1995 to Demarest et al. discloses a table with seven player positions, a dealer position and a wager pool area 31.

The known prior art is described above. None of the known prior art disclose the game set forth herein.

SUMMARY OF THE INVENTION

In accordance with the invention claimed, one object of this invention is to provide a new table game for use in the gaming industry in which every bettor has an equal chance to win.

It is another object of this invention to provide a new card game for use in the gaming industry which includes simple and easy to learn rules based upon card rank as opposed to numerical values.

It is still another object of the invention to provide a novel game which provides the sponsors of the game the ability to choose one of a variety of payout plans.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
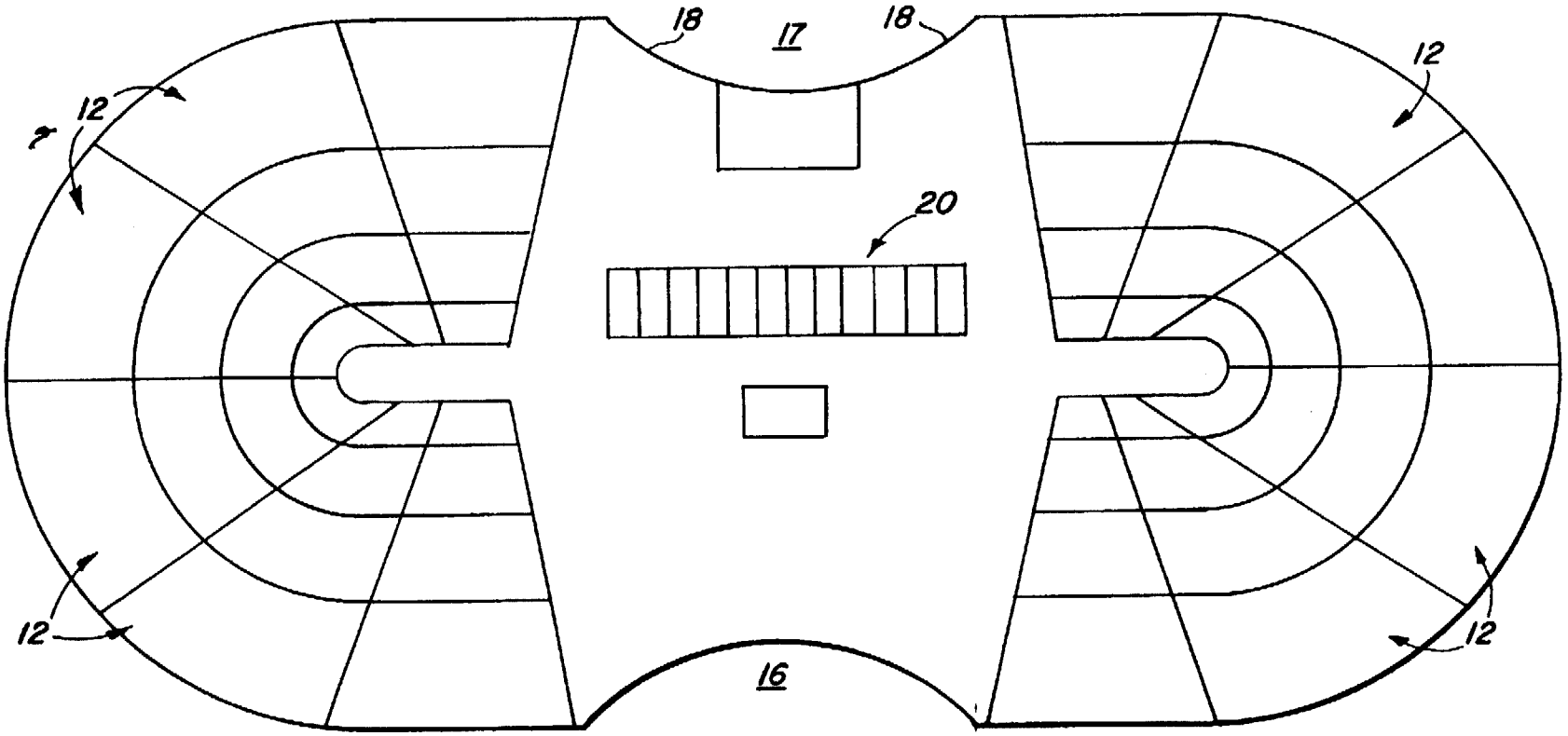
FIG. 1 (PRIOR ART)
FIG. 1 is a top view of a gaming table used in baccarat (prior art)
Figure 2:
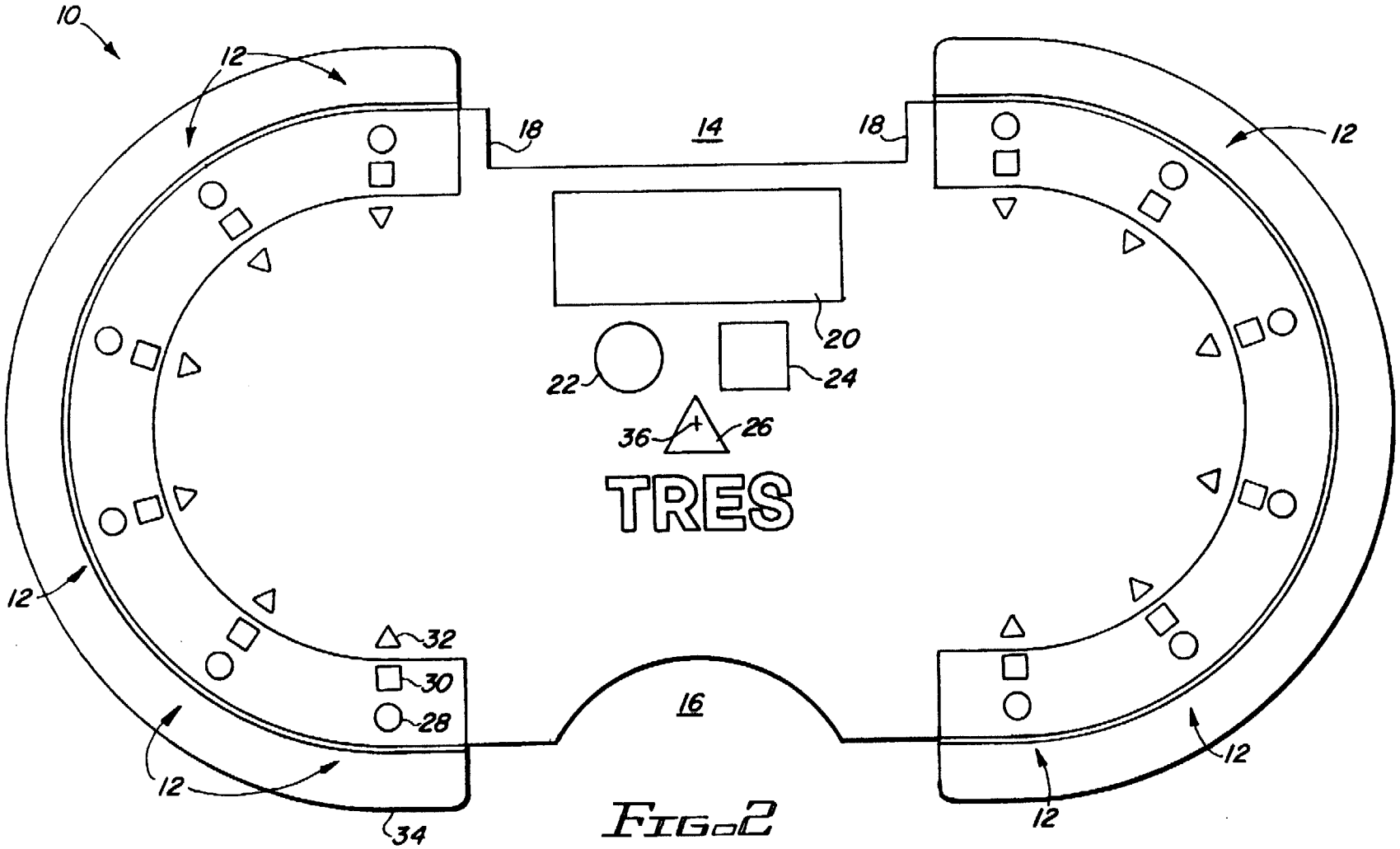
FIG. 2 is a top view of a gaming table used in the present invention.

In accordance with the invention claimed, FIG. 2 discloses a novel TRES™ table game and apparatus therefore. As shown in FIG. 2, the game is played on an oval gaming table 10 which comprises a plurality of bettor's stations 12, a dealers' station 14 and a caller's station 16. Those skilled in the art will recognize that the oval gaming table 10 is generally a table cover which will fit over the top of a standard baccarat table shown in FIG. 1.

As in bacarrat, two dealers 18 are responsible for paying bets when bettors win and removing bets when bettors lose while the the caller 16 is responsible for directing the game, the deal, the outcome and the passing of the shoe. The shoe passes from bettor to bettor as the game progresses.

In the illustrated embodiment, twelve (12) bettor's stations 12 are provided, though variations on this number are obviously possible. The game as described can have as few as one bettor participating. However, the presently preferred embodiment of twelve bettor's stations 12 provides a game manageable by two dealers and a single caller. However, those skilled in the art will recognize that, like baccarat and mini-baccarat, the present invention is easily adaptable to management by a single casino employee combining the functions of dealer/caller. Each of the twelve bettor's stations 12 are provided with a small circle 28, small square 30 and small triangle 32 which are oriented linearly and radiating axially from a periphery 34 towards a center 36 of table 10.

Dealer's station 14 includes spaces for two dealers 18, a coin box 20 for storing the casino's money and a circle 22, a square 24 and a triangle 26 imprinted thereon. Dealers' circle 22, square 24 and triangle 26 correspond to small circles 28, small squares 30 and small triangles 32 of each bettor's station 12 as described below.

It will be understood by those skilled in the art that the shape, arrangement and positioning of circles 22 and 28, squares 24 and 30 and triangles 26 and 32 are not critical to the invention. Many other variations of these names, shapes, arrangements and positions are possible without departing from the scope of the invention.

The game is played with, preferably, a plurality of standard decks minus jokers. As is well known in the gaming art, standard card decks comprise fifty-two cards having four thirteen card suits each. Preferably, the four (4) suits are the typical spades, hearts, diamonds and clubs. The plurality of decks, generally six to eight, are preferably machine shuffled and dispersed from a standard card shoe (not shown).

To play the game, the bettors will place their initial wages using one of three options. To place a wager, a bettor will place their wager in either small circle 28, small square 30 or small triangle 32 at their respective bettor's station 12. Small circle 28 corresponds to a bet on the player, small square 30 corresponds to a bet on the banker and small triangle 32 corresponds to a bet on a tie. The dealers will track the wagers.

The banker, who can be an individual bettor or, alternatively, a dealer, deals face up two cards, one card each into circle 22 (player) and square 24 (banker). Each card is called by the caller in caller position 16.

If one of the cards in either circle 22 or square 24 is an ace, an ace alto is called wherein the ace wins the hand. If both cards are aces, all bets win. If either card is a two, a deuce alto is called wherein the two loses. However, on deuce alto, the high hand will push as described below. If both cards are twos, only the tie bet wins.

If neither an ace alto nor deuce alto is drawn, a third card termed the tres is drawn.

If the card in circle 22 is the same face value as the card in square 24, a natural tie results and the tres card is played into triangle 26. In a natural tie, if the tres card is lower than the tied cards, both banker and player win. If the tres card is higher than the tied cards, both banker and player lose. If the tres card matches the other two cards, all bets win.

If the card in circle 22 is not the same face value as the card in square 24, the tres card is played to cover the card having the lower face value. In this situation, the high card (either the tres or the uncovered card) is the winner. If the tres card has an equal face value to the uncovered card a draw tie results. The tie bet wins but the banker and the player push their bets.

In the presently preferred method of paying off bets, the winning hand (banker or player) or tres pays one to one. Winning a tie bet will pay seven to one. In the game as described and unlike baccarat, the banker and the player will have equal odds to win. Those skilled in the art will recognize that many other variations of this payout schedule are possible without departing from the scope of the invention.

To provide a casino with its percentage, or vigor, the deuce alto push is the key to various payout schedules. The rules may be altered to require the high hand to push on either three through any selected card such as king, ten, nine or eight as desired. By doing so, the casino will collect the losing bets while not paying out on the high hand on a deuce alto.

Statistical calculations, based upon a six deck shoe, indicate that a casino will receive the following percentages of bets based upon the various deuce alto push rules:

1) on three through king, 6.064%;
2) on three through ten, 4.289%;
3) on three through nine, 3.698%;
4) on three through eight, 3.106%;
5) on three through seven, 2.513%;
6) on three through six, 1.922%; and
7) on three through five, 1.331%.

It should be noted that these calculations take into account the casino losses due to the three matching card all bets win payout which will be 0.444% on a one to one payout.

Although only certain embodiments have been illustrated and described, it will be apparent to those skilled in the art that various changes and modifications may be made therein without departing from the spirit of the invention or from the scope of the appended claims.

What is claimed is:

1. A method of playing a game for a one or more bettors comprising the step of:

providing a standard deck of cards;

providing each of the one or more bettors means for denoting a bet on a banker, a player and a tie;

each bettor placing a wager on the denoting means on one of the banker, a player or a tie to participate in the game;

dealing two cards, one card each to the banker and to the player;

determining whether either or both of the cards dealt is an ace wherein the ace wins the hand;

determining whether either or both of the cards dealt is a two wherein the two loses the hand, unless both of the cards are twos wherein only the tie bet wins;

if neither of the first two cards is an ace or a two, drawing a tres card, then;

determining if the two cards have the same face value;

determining whether the tres card is a lesser face value than the two cards having the same face value wherein the banker and the player win the hand;

determining whether the tres card is a greater face value than the two cards having the same face value wherein the banker and the player lose the hand;

determining whether the tres card is of equal face value to the two cards having the same face value wherein all the bettors win;

determining if the two cards have the different face values wherein the tres card is played to cover the one of the two cards having the lower face value;

determining if the tres card is equal in value to one of the two cards having the higher face value wherein the tie bet wins;

determining if the tres card and the one of the two cards having the higher face value have different face values wherein the higher of the tres card or the one of the two cards having the higher face value wins the bet.

2. The game of claim 1 wherein the step of determining if the tres card is equal in value to one of the two cards having the higher face value wherein the tie bet wins further comprises having the banker and the player push their bets.

3. The game of claim 1 wherein the step of determining whether either or both of the cards dealt is a two wherein the two loses the hand, unless both of the card is a two wherein only the tie bet wins, further comprises pushing the high hand if the face value of the high hand is between a predetermined range of values.

4. The game of claim 3 wherein the range is three to king.

5. The game of claim 3 wherein the range is three to ten.

6. The game of claim 3 wherein the range is three to nine.

7. The game of claim 3 wherein the range is three to eight.

8. The game of claim 3 wherein the range is three to seven.

* * * * *